United States Patent [19]

Bagus et al.

[11] 4,206,674

[45] Jun. 10, 1980

[54] DC OFFSET CORRECTION CIRCUIT FOR AN ELECTRONIC MUSICAL INSTRUMENT

[75] Inventors: Brian M. Bagus, Bartlett; Ray B. Schrecongost, Park Ridge, both of Ill.

[73] Assignee: Marmon Company, Chicago, Ill.

[21] Appl. No.: 917,878

[22] Filed: Jun. 22, 1978

[51] Int. Cl.[2] ..... G10H 1/00

[52] U.S. Cl. ..... 84/1.01; 84/1.26; 84/DIG. 8; 84/DIG. 23

[58] Field of Search ..... 84/1.27, 1.26, DIG. 8, 84/1.01, DIG. 23, 1.13; 330/9

[56] References Cited

U.S. PATENT DOCUMENTS

| | | | |
|---|---|---|---|
| 3,733,955 | 5/1973 | Reinagel et al. | 84/DIG. 8 |
| 3,823,244 | 7/1974 | Nagahama | 84/1.26 |
| 3,872,764 | 3/1975 | Munch, Jr. et al. | 84/DIG. 8 |
| 3,999,149 | 12/1976 | Uetrecht | 84/1.26 |
| 4,136,595 | 1/1979 | Gillette | 84/1.01 |

OTHER PUBLICATIONS

B. Ward, Electronic Music Circuit Guidebook, 1975, pp. 141–145.

*Primary Examiner*—Gene Z. Rubinson
*Assistant Examiner*—Forester W. Isen
*Attorney, Agent, or Firm*—Neuman, Williams, Anderson & Olson

[57] ABSTRACT

A DC offset correction circuit for use in an electronic organ for eliminating audible noise or thump produced by an instantaneous DC level shift in the standard organ keyer circuit at both key depression and release. A standard keyer circuit is responsive to the depression of a key on the manual by the organist and provides a square or stairstep waveform output at a frequency representative of the note key depressed. Each keyer output waveform includes a positive or negative polarity instantaneous DC level shift at both key depression and release which when coupled through a capacitive output circuit, such as a filter, provides an undesirable audible thump. The DC offset correction circuit comprises a monitoring circuit which is responsive to both key depression and release and a detector circuit responsive to the monitoring circuit to provide a DC level signal output of opposite polarity to the instantaneous DC level shift in the keyer circuit. The correction circuit further comprises a resistive combining circuit which receives the output signals from all the keyer circuits and the output signals from the monitoring circuit to provide a corrected output signal waveform without an instantaneous DC level shift. Standard organ output circuits receive the corrected output signal and provide corresponding audio output without the undesirable audible thump.

7 Claims, 2 Drawing Figures

FIG. 1
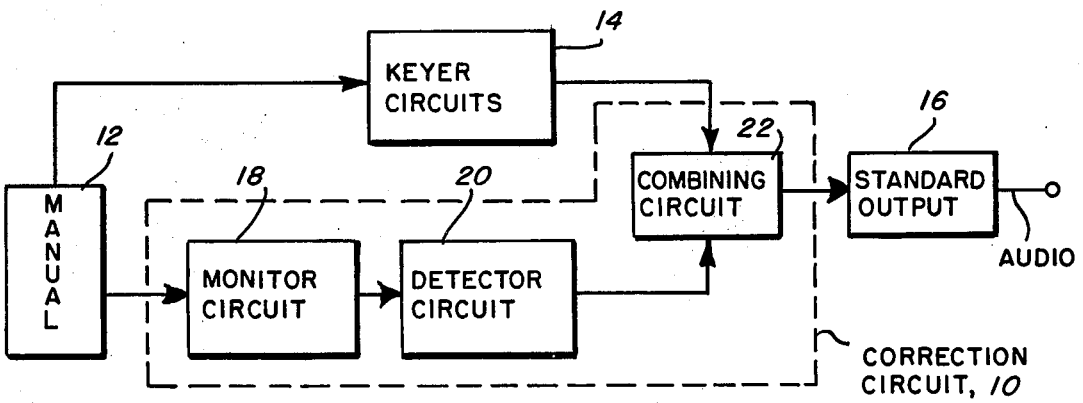
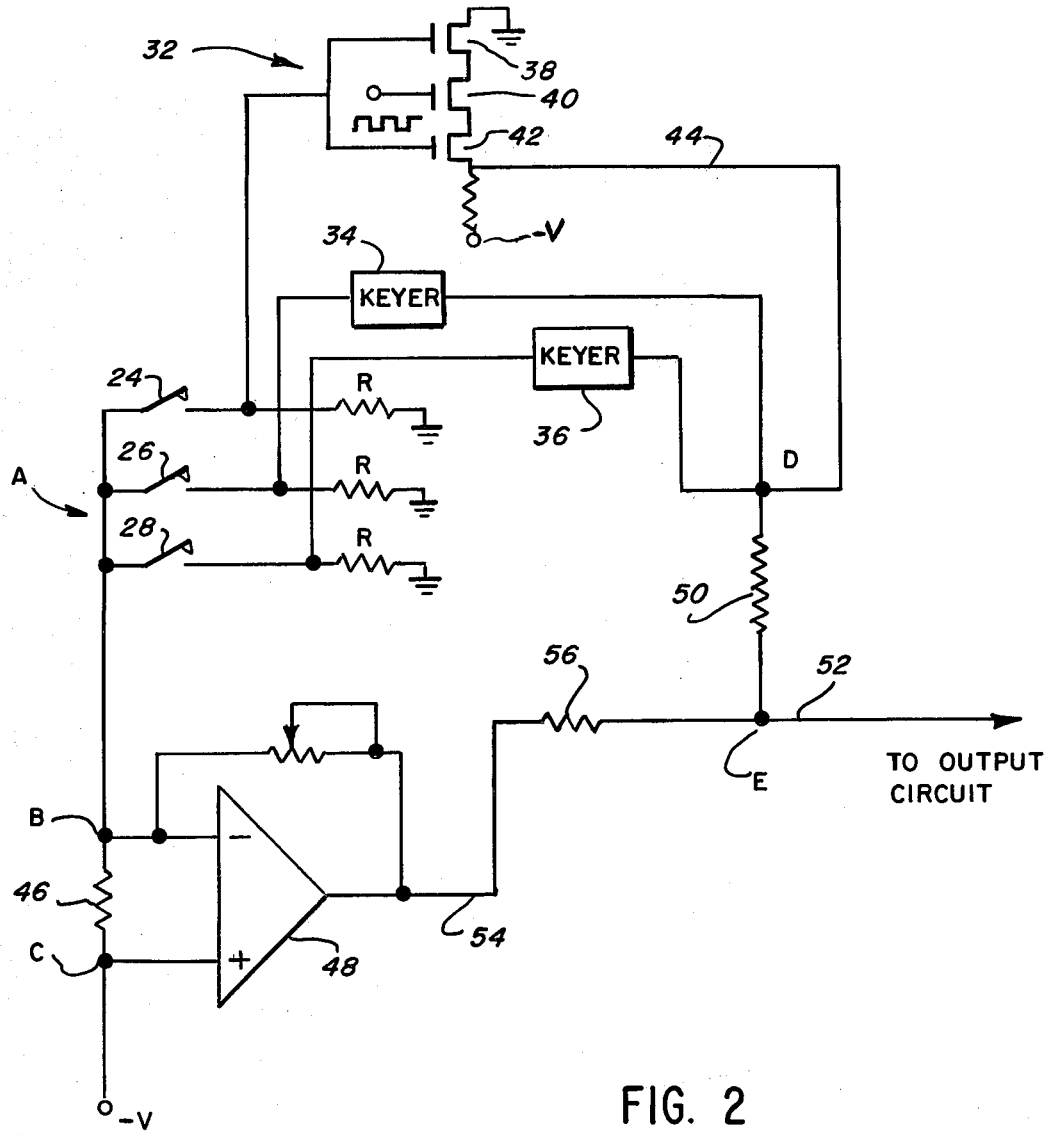
FIG. 2

DC OFFSET CORRECTION CIRCUIT FOR AN ELECTRONIC MUSICAL INSTRUMENT

BACKGROUND OF THE INVENTION

1. Field of the Invention

The present invention is a DC offset correction circuit for use in an electronic organ. The correction circuit eliminates the audible noise or thump in the audio output signal caused by an instantaneous DC level shift in the keyer output signal at each key depression and release.

While the present invention is described herein with reference to particular embodiments, it should be understood that the invention is not limited thereto. The correction circuit of the present invention may be employed in a variety of forms, as one skilled in the art will recognize in light of the present disclosure.

2. Prior Art

The undesirable audible noise or thump in the audio signal caused by the instantaneous DC level shift in the keyer output waveform at key depression and release is commonly eliminated in electronic organs by providing a RC time constant circuit at the signal input to each keyer circuit. The RC time constant circuit provides for a very slow response by the keyer circuit so that the DC shift in the keyer output waveform is not instantaneous but rather very gradual. The use of RC time constant circuits at each keyer input significantly reduces the audible noise at key depression and release. However, since the keyer circuit turns on slowly, it diminishes the attack time of the keyer output signal and restricts the rapidity at which the organist can play certain musical pieces. If the organist moves too rapidly from one key to another, the keyer circuit is activated for a reduced time interval and the audio output is diminished or sluggish. In addition since there are many keyer circuits in an organ and each requires its own time constant circuit, the cost in both electrical components as well as assembly time is great.

Another common approach to eliminating audible noise due to the instantaneous DC shift in the keyer circuits is to filter the keyer output signal. Usually, the output lines of several, frequently six or more, keyer circuits which are harmonically related are tied together and applied as the input to a single filter circuit which passes the desirable audio frequency signals but attenuates the unwanted noise. This approach is restricted for use with a small number of keyer circuits because of band width limitations. Furthermore, if the cut off point of the filter is high enough to attenuate noise, the lower frequency notes sound raspy and if the cut off point is low, some percentage of the noise signal may not be attenuated and the audible thump remains in the output. In addition to the above, the component cost of the many necessary filters and the assembly time is great.

An object of the present invention is to overcome the disadvantages and deficiencies of the prior art devices.

Another object of the corrective circuit is to eliminate audible noise or thump in the audio output due to the positive and negative instantaneous DC level shift in the output waveform of the keyer circuit at key depression and release by combining with the keyer output a DC level signal of opposite polarity to the instantaneous DC shift.

Another object is to eliminate the thump in the audio output caused by each keyer circuit by using a single corrective circuit.

Other objects will be apparent from the following summary and detailed description.

SUMMARY OF THE INVENTION

A DC offset correction circuit for use in an electronic organ for eliminating audible noise or thump in the audio signal due to an instantaneous DC level shift in the keyer circuit output waveform at key depression and release. An electronic organ includes at least one keyboard or manual, a plurality of keyer circuits having outputs, a plurality of keying lines connecting the keyboard to the keyer circuits, and an audio output circuit responsive to the keyer outputs for providing an audio signal. Each time the organist depresses a key on the manual, one of the keyer circuits receives an input signal corresponding to the depressed key. The keyer circuit produces a waveform output at a frequency corresponding to the note key depressed. The keyer output signal has an instantaneous DC level shift at key depression which when capacitively coupled through the standard output circuit produces an audible noise or thump in the audio signal. When the instrument player releases the key, the keyer circuit returns to its quiescent state and there is an opposite polarity instantaneous DC level shift in the output waveform which when coupled through the standard output circuit again produces an audible thump. To eliminate the undesirable audible thump, each keying line is also connected to the DC offset correction circuit which provides an output signal of opposite polarity to the instantaneous DC shift from the keyer circuits and which combines with the keyer output to eliminate the net instantaneous DC level shift.

The depression of each key on the manual closes a key switch. The switch side of each key switch is connected to the keying bus and a negative voltage. A monitoring resistor is connected in series in the keying bus so that for each key depressed, a greater amount of current is drawn from the negative voltage source and a correspondingly greater voltage drop occurs across the monitoring resistor. An operational amplifier is connected across the monitoring resistor and provides a DC level output signal proportional to the voltage drop across the monitoring resistor. The instantaneous voltage shift from the keyer circuit is positive going in polarity at key depression, therefore, the DC level output of the operational amplifier is negative in polarity. The output from each keyer circuit and the output from the operational amplifier are applied to a mixing or combining circuit. The mixing circuit is a resistive divider network which combines its inputs so that its output is biased to remove the instantaneous DC level shift. If additional keys are depressed by the organist, a greater amount of current is drawn through the monitoring resistor with a correspondingly increased voltage across the monitoring resistor. The operational amplifier detects the increased voltage drop and provides an increased DC level signal for combining with the keyer output signals to offset the increased instantaneous DC level shift from the new key depression. When any depressed key is released, the keyer circuit has an instantaneous negative going DC level shift and since less current is drawn through the monitoring resistor the operational amplifier detects a reduced voltage drop and provides a reduced DC level signal thereby offsetting the net DC level shift and eliminating any audible thump in the output. The single correction circuit provides the opposite polarity offsetting DC level signal for all of the keyer circuits at both key depression and release regardless of the number of keys actuated. The output of the mixing circuit portion of the corrective circuit is connected to a standard organ audio output circuit for producing audio without an audible thump.

BRIEF DESCRIPTION OF THE DRAWINGS

FIG. 1 is a block diagram illustrating the correction circuit in combination with standard circuits in an electronic organ.

FIG. 2 is a partial schematic diagram of the correction circuit in combination with standard circuits in an electronic organ.

DETAILED DESCRIPTION

FIG. 1 illustrates the correction circuit 10 in combination with other electronic organ circuits. The other standard organ circuits include at least one keyboard or manual 12 having a plurality of keys, a plurality of keyer circuits 14, a plurality of keying lines connecting the keys with separate keyer circuits and an audio output circuit 16. While in the preferred embodiment, the connection between the keys and the keyer circuits is a parallel data approach, it should be apparent to one of ordinary skill in the art that a serial data approach could be used. The output signal waveform of each keyer circuit 14 is connected through a standard audio output circuit 16. The standard audio output circuit 16 comprises preamplifiers and filters as is well-known in the art and further description is considered unnecessary.

When an instrument player depresses a key on the organ manual 12, a keyer circuit 14 is activated. The keyer circuit provides a square wave output signal waveform at a frequency corresponding to the note key depressed. It should be apparent to those of ordinary skill in the art that the keyer output can be other well-known waveforms such as a stairstep or a rectangular. In the preferred embodiment, the keyer output signal waveform has a two hundred millivolt peak-to-peak voltage swing. Therefore, at both key depression and release the waveform has an instantaneous one hundred millivolt DC level shift. Since the keyer output signal is capacitively coupled through the standard audio output circuit 16, when the instrument player depresses a key on manual 12, the positive instantaneous DC shift causes an audible thump or noise and when the instrument player releases the depressed key the keyer circuit 14 has a negative instantaneous DC level shift which through audio circuit 16 also causes an audible thump. The DC offset correction circuit 10 offsets or biases the instantaneous DC level shift in the keyer output signal waveform at both key depression and key release so that no net DC level shift is received by the audio circuit 16 and therefore no audible thump occurs in the audio output.

The correction circuit 10 comprises a monitoring circuit 18 which is connected to the manual 12 and which indicates that a key is depressed or released; a detector circuit 20 which responds to the monitor circuit 18 and provides a DC level output signal of opposite polarity than the instantaneous DC level shift of the keyer circuit 14; and, a combining circuit 22 which receives both the keyer output and the detector output and offsets the instantaneous DC level shift. A standard audio output circuit 16 receives the output signal from combining circuit 22 and since the instantaneous DC level shift in the keyer output waveform is offset, provides an audio signal without an audible thump.

In FIG. 2, a plurality of key switches 24, 26 and 28 are shown as a portion of the manual 12. The number of key switches corresponds to the number of keys and only three are illustrated for clarity. When the organist plays the key corresponding to the note C, key switch 24 closes and remains closed until the key is released by the organist. In the preferred embodiment, the switch side of each key switch is tied to a common point A on manual bus line 30. The bus line 30 connects the common point A of the key switches to a negative voltage source −V. It should be apparent to one of ordinary skill in the art that while the preferred embodiment is described with reference to negative voltage, a positive voltage could be used with the necessary modifications in the system. The other side or contact side of each key switch is connected through a load resistor R to ground and respectively to the input of one of the keyer circuits 32, 34 and 36. Thus when the instrument player actuates the C note key on the manual 12, key switch 24 closes and a negative voltage signal is applied to the input of keyer circuit 32. The keyer circuits 32, 34 and 36 are well-known in the electronic organ industry and only a generalized description is set forth herein.

In the preferred embodiment, keyer circuit 32 is a FET keyer, however, it should be apparent that a diode keyer as well as other known types of keyer circuits may be used. The keyer circuit 32 comprises three series connected FET's 38, 40 and 42. A square wave signal is applied to the gate input of FET 40 and the signal from key switch 24 is applied to the input of FET 38 and 42. When the keyer circuit 32 receives a signal from key switch 24, the FET's 38 and 42 provide a suitable resistance and the square wave input to FET 40 appears at the output on line 44. The output square wave signal on line 44 has approximately 200 millivolt peak-to-peak voltage swing and has an instantaneous positive going DC voltage level shift of approximately 100 millivolts at key depression and an instantaneous negative going DC voltage level shift of approximately 100 millivolts at key release.

A resistor 46 is connected in series in the bus line 30 between the common point A of the switch side of the key switches and the negative voltage source, −V. Now when key switch 24 closes, the load resistor R and resistor 46 form a voltage divider and a specific amount of current is drawn through resistor 46 and a corresponding voltage drop occurs across resistor 46. An operational amplifier 48 is connected across resistor 46 with its inverting input connected at point B between one end of resistor 46 and the common point A of the key switches. The non-inverting input of operational amplifier 48 is connected at point C between the other end of resistor 46 and the negative voltage −V. When the C note key is depressed by the instrument player and key switch 24 closes, point B becomes more positive. Since point B is connected to the inverting input of operational amplifier 48, the output of operational amplifier 48 on line 54 is a DC voltage with an initial negative going step.

The output from each keyer circuit 32, 34 and 36 is connected together at a common point D. Point D is connected to one end of a resistor 50 and the other end of resistor 50 is connected to point E on line 52. The output from the operational amplifier 48 on line 54 is connected to resistor 56. The other side of resistor 56 is connected to point E on line 52. In the preferred embodiment, the ratio between resistors 56 and 50 is approximately 10 to 1. Since the DC output signal from operational amplifier 48 is of opposite going polarity than the instantaneous DC level shift in the output signal waveform from the keyer circuit 32, the square waveform output signal from the keyer circuit 32 is biased to eliminate the instantaneous DC level shift at both key depression and release. The square wave output signal from the keyer circuit now swings around a new bias or reference level so that the audio output circuit 16 does not receive a net DC level change. Therefore, audio output circuit 16 provides an audio signal without the audible thump.

If the instrument player depresses a second key on the manual 12, such as note key C#, key switch 26 closes. If the instrument player has not released previously depressed note key C, then key switch 24 remains closed. Now, the two load resistors R and resistor 46 form a voltage divider circuit and more current is drawn through resistor 46. Point B now becomes still more positive. In response to the increase potential across resistor 46, the operational amplifier produces an increased negative going DC level voltage on output line 54. The output signal is applied through resistor 56 to point E on line 52. The output signals from keyer circuits 32 and 34 are combined at point D and are applied through resistor 50 to common point E. The increased negative going DC level voltage signal from operational amplifier 48 again readjusts the bias for the combined output signal waveform from keyer circuits 32 and 34 so that the audio output circuit 16 does not receive a net DC level shift. Therefore, output circuit 16 provides an audio signal without audible thump.

If one of the depressed keys such as the note C# key is released by the instrument player, the key switch 26 opens and if the depressed note C key remains depressed, key switch 24 remains closed. Now, the resistor R and resistor 46 form a voltage divider and less current is drawn through resistor 46. Therefore, point B becomes less positive and the DC level signal from operational amplifier 48 changes to have a less negative step. The new DC level signal output of operational amplifier 48 on line 54 is applied through resistor 56 to point E. The output signal waveform from keyer circuit 34 is removed and only the output signal waveform from keyer circuit 32 is applied on output line 44 through resistor 50 to point E. The bias level for the square wave output signal from keyer circuit 32 changes from the previous bias level with two keys depressed, however, the opposite polarity DC level signal from operational amplifier 48 is correspondingly lower. Therefore, the new signal from operational amplifier 48 adjusts the bias level or point for the output signal waveform from keyer circuit 32 to offset the instantaneous DC level shift so that the signal waveform received by audio output circuit 16 does not have a net DC level shift even though note C# key is released and key switch 26 is opened. Therefore, audio output circuit 16 provides an audio output signal without audible thump even though a key is released.

The above operation is identical regardless of the number of keys depressed by the instrument player and regardless of the number or sequence of keys released. Since the turn-on time or response of the keyer circuits is unaltered, the attack time for the musical output signal is not affected. Furthermore, the speed or rapidity at which the organist plays is not restricted. Thus, a single correction circuit monitors each key depression and release, provides an opposite polarity DC level output signal with the magnitude of the DC level shift depending upon the number of keys depressed or released and combines the output signal waveform from the keyer circuits with the opposite polarity DC level output signal to bias or offset the instantaneous DC level shift in the keyer output waveform at both key depression and key release. Since a single correction circuit functions with many keyer circuits, only a single correction circuit is required for the standard organ. Therefore, the cost savings in components and in assembly time is significantly increased when compared to conventional techniques.

It is to be understood that the present disclosure is to be interpreted in its broadest sense and the invention is not to be limited to the specific embodiments disclosed. Furthermore, the embodiments set forth can be modified or varied by applying current knowledge without departing from the spirit and scope of the novel concepts of the invention.

Having described the invention, what is claimed is:

1. A DC offset correction circuit in combination with an electronic organ having a keyboard, a keyer circuit, at least one keying line connecting said keyboard to said keyer circuit, said keyer circuit providing an output signal waveform at a frequency representative of a key activated, said output signal having instantaneous DC level shifts, and an audio output circuit, said DC offset correction circuit comprising:

a monitoring means connected to said keyboard and responsive to the actuation of each key for providing an output signal indicating that a key is being actuated regardless of the number of keys previously actuated;

a detector means responsive to said output signal from said monitoring means for providing a DC voltage level output signal for each key actuation; and, a combining circuit responsive to said output signal waveform from said keyer circuit and said DC output signal from said detector means for offsetting said instantaneous DC level shift in said keyer output signal and providing an output signal with no net DC level shift to said audio output circuit.

2. A DC offset correction circuit as set forth in claim 1 wherein said keyboard comprises a plurality of key switches with one side of each switch tied together forming a common point, a voltage source, a bus line connecting said voltage source to said common point, and wherein said monitoring circuit comprises a resistor connected in series in said bus line between said voltage source and said common point.

3. A DC offset correction circuit as set forth in claim 2 wherein said detector circuit comprises an operational amplifier with input lines connected across said resistor so that when a key is depressed and current drawn through said resistor causing a potential across said resistor said operational amplifier provides a corresponding DC level output signal and when a key is released and less current drawn through said resistor causing a change in potential across said resistor said operational amplifier provides a corresponding DC level output signal.

4. A DC offset correction circuit as set forth in claim 3 wherein said combining circuit comprises a resistive mixing network.

5. A DC offset correction circuit as set forth in claim 4 wherein said DC level output signal from said operational amplifier is the opposite polarity as said instantaneous DC level output signal from said keyer circuit.

6. A DC offset correction circuit as set forth in claim 5 wherein said output signal waveform from said keyer circuit is a rectangular waveform.

7. A DC offset correction circuit as set forth in claim 5 wherein said output signal waveform from said keyer circuit is a stairstep waveform.

* * * * *